US006477950B1

(12) United States Patent
Feilen et al.

(10) Patent No.: US 6,477,950 B1
(45) Date of Patent: Nov. 12, 2002

(54) APPARATUS AND METHOD FOR DUPLEX PRINTING OF A SHEET-LIKE SUBSTRATE

(76) Inventors: Michael Alan Feilen, 39 W. 389 Hogan Hill, Elgin, IL (US) 60123; Jordan David Mann, 917 Apple Dr., Schaumburg, IL (US) 60194

( * ) Notice: Subject to any disclaimer, the term of this patent is extended or adjusted under 35 U.S.C. 154(b) by 0 days.

(21) Appl. No.: 09/547,554

(22) Filed: Apr. 12, 2000

(51) Int. Cl.[7] ..... B41F 5/02

(52) U.S. Cl. ..... 101/230; 101/229; 101/231; 271/185; 271/186

(58) Field of Search ..... 101/230, 231, 101/229; 347/102; 400/188, 177; 271/65, 185, 186, 225

(56) References Cited

U.S. PATENT DOCUMENTS

| | | | | |
|---|---|---|---|---|
| 3,946,669 A | * | 3/1976 | Johne et al. | 101/230 |
| 4,456,236 A | | 6/1984 | Buddendeck | |
| 4,586,812 A | | 5/1986 | Kaneko et al. | |
| 4,699,365 A | * | 10/1987 | Smith et al. | 271/3.1 |
| 4,730,526 A | | 3/1988 | Pearl et al. | |
| 4,972,236 A | | 11/1990 | Hasegawa | |
| 5,028,154 A | | 7/1991 | Cull | |
| 5,137,494 A | | 8/1992 | Schubert et al. | |
| 5,233,401 A | | 8/1993 | Sasaki et al. | |
| 5,284,816 A | | 2/1994 | Stephenson | |
| 5,365,846 A | | 11/1994 | Becker | |
| 5,443,254 A | | 8/1995 | Reist | |
| 5,467,710 A | | 11/1995 | Wirz | |
| 5,479,856 A | | 1/1996 | Wirz | |
| 5,486,932 A | | 1/1996 | Leonard | |
| 5,520,112 A | | 5/1996 | Schleinz et al. | |
| 5,526,107 A | | 6/1996 | Bronstein | |
| 5,526,748 A | | 6/1996 | Schleinz et al. | |
| 5,670,995 A | | 9/1997 | Kupcho et al. | |
| 5,688,057 A | | 11/1997 | Wright et al. | |
| 5,732,623 A | * | 3/1998 | Compera et al. | 101/232 |
| 5,740,510 A | | 4/1998 | Van den Bogaert et al. | |
| 5,792,260 A | | 8/1998 | Rantanen et al. | |
| 5,815,783 A | | 9/1998 | Lior et al. | |
| 5,829,707 A | | 11/1998 | Lamothe | |
| 5,835,114 A | | 11/1998 | Nagata et al. | |
| 5,836,706 A | | 11/1998 | Ruhe | |
| 5,855,367 A | | 1/1999 | Inoue et al. | |
| 5,887,865 A | | 3/1999 | Ishimaru | |
| 5,899,615 A | | 5/1999 | Sansone | |
| 5,957,598 A | | 9/1999 | Berkers et al. | |
| 5,964,153 A | | 10/1999 | Grieve | |
| 6,000,867 A | | 12/1999 | Yoshii et al. | |
| 6,022,089 A | | 2/2000 | Mori | |
| 6,086,274 A | * | 7/2000 | Krzyminski | 400/703 |
| 6,267,518 B1 | * | 7/2001 | Abe | 400/188 |

FOREIGN PATENT DOCUMENTS

| | | | | |
|---|---|---|---|---|
| JP | 2-261753 A | * | 10/1990 | 271/225 |
| JP | 5-185661 A | * | 7/1993 | 347/42 |

* cited by examiner

*Primary Examiner*—Andrew H. Hirshfeld
*Assistant Examiner*—Minh H. Chau

(57) ABSTRACT

The present invention is an apparatus and method for duplex printing of a sheet-like substrate in a continuous single-pass flat printing process. The device comprises a first conveyor unit in communication with a feeder and a second conveyor unit in communication with a delivery. Each conveyor unit has a printing device and a drying/curing device disposed adjacent to the conveyor unit for applying a printed material to the substrate. A transfer device is disposed between the two conveyor units for transferring the substrate from the first conveyor unit to the second conveyor unit and turning the substrate, thereby allowing both sides of the substrate to be printed. Alternative embodiments may include any number of conveyor units and transfer units.

17 Claims, 1 Drawing Sheet

APPARATUS AND METHOD FOR DUPLEX PRINTING OF A SHEET-LIKE SUBSTRATE

TECHNICAL FIELD

The present invention relates to two-sided printing of sheet material, and more particularly to an apparatus and method for two-sided printing of a sheet-like substrate in a continuous single-pass conveyor-type process.

BACKGROUND OF THE INVENTION

Various sheet-fed printing systems are known for printing or photocopying text or graphical images on a recording substrate such as a paper or polymer sheet. Many of these systems include means for two-sided printing that involve mechanisms for turning the sheet that has been printed on one side by a printing device and passing the sheet through either a second printing device or the same printing device that was used to print the first side of the sheet. These mechanisms typically utilize a combination of one or more drums, rollers, cylinders, gears, levers and/or sheet guides to turn the sheets. In recto/verso printing devices, these transport mechanisms typically involve bending and manipulating the sheets through a series of drums or rollers.

For example, U.S. Pat. No. 5,964,153 describes a turning device for sheet-fed printing presses that utilizes a turning mechanism that accepts a sheet from the end of a printing path and re-feeds the sheet in an opposite direction into the beginning of the printing path, thereby turning the sheet for printing on a second side. This device requires the sheet to be fed through the same printing path twice. This device also utilizes a plurality of rollers and drivers to move the sheet through the device.

Another example is U.S. Pat. No. 5,233,401, which describes a two-sided printing apparatus that utilizes a sheet re-feeding unit. In this device, a sheet is printed on one side by a printing unit and is re-fed through the device in order to print a second side of the sheet.

While these devices tend to be more suitable for duplex printing of relatively thin sheets in photo-imaging systems and computer printers, they are not conducive to commercial sheet-fed printing systems for duplex printing of thicker sheets or substrates in a continuous single-pass process. These mechanisms are not capable of turning and manipulating thicker printing substrates that tend to be rigid and more suitable for flat conveyor-type printing arrangements. Furthermore, these mechanisms are typically more complex and tend to be more expensive. Such mechanisms are also not practicable to implement in a continuous single-pass flat conveyor-type printing process for industrial and commercial applications.

While single-pass two-sided printing devices have been provided in rotary printing arrangements for commercial printing (e.g. U.S. Pat. No. 5,467,710, which describes a rotary printing press for two-sided printing of sheets that involves passing the sheet through a rotary printing press having two printing units including plates and impression cylinders), a single-pass two-sided printing apparatus in a flat conveyor-type printing arrangement is not presently known. Existing two-sided printing processes that utilize this type of arrangement typically require a substrate to be processed two or more times through the same apparatus. This has a significant effect on production cycle times.

Therefore, it is an object of the present invention to provide an apparatus and method for single-pass duplex printing of a sheet-like substrate in a flat, continuous, and substantially in-line printing arrangement.

It is also an object of the present invention to provide an apparatus and method for duplex printing of a sheet-like substrate that utilizes a simple and economical sheet-turning arrangement to allow for two-sided printing of a sheet-like substrate in a flat, continuous, and substantially in-line printing arrangement.

It is a further object of the present invention to provide an apparatus and method for duplex printing of a sheet-like substrate that is economical and conducive to commercial and industrial printing applications.

These and other objects will become readily apparent after reviewing the specification and drawings.

SUMMARY OF THE INVENTION

The present invention is an apparatus and method for duplex printing of a sheet-like substrate in a continuous single-pass flat printing process. The device comprises a first conveyor unit in communication with a feeder and a second conveyor unit in communication with a delivery. Each conveyor unit has a printing device and a drying/curing device disposed adjacent to the conveyor unit. A transfer device is disposed between the two conveyor units for transferring a substrate from the first conveyor unit to the second conveyor unit. As a substrate is conveyed on the first conveyor unit from the feeder, a first printing unit prints a first side of the substrate. A first drying/curing device dries or cures the material printed on the first side of the substrate. The transfer device turns the substrate over as it transfers the substrate to the second conveyor unit to expose a second side of the substrate to a second printing device disposed adjacent to the second conveyor unit. A second drying/curing device dries or cures the material printed on the second side of the substrate. The second conveyor unit conveys the printed substrate to the delivery. Alternate embodiments may include additional conveyor units to facilitate relative positioning of the elements of the apparatus or to facilitate further processing of the substrates at other locations.

DETAILED DESCRIPTION OF THE PREFERRED EMBODIMENTS

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
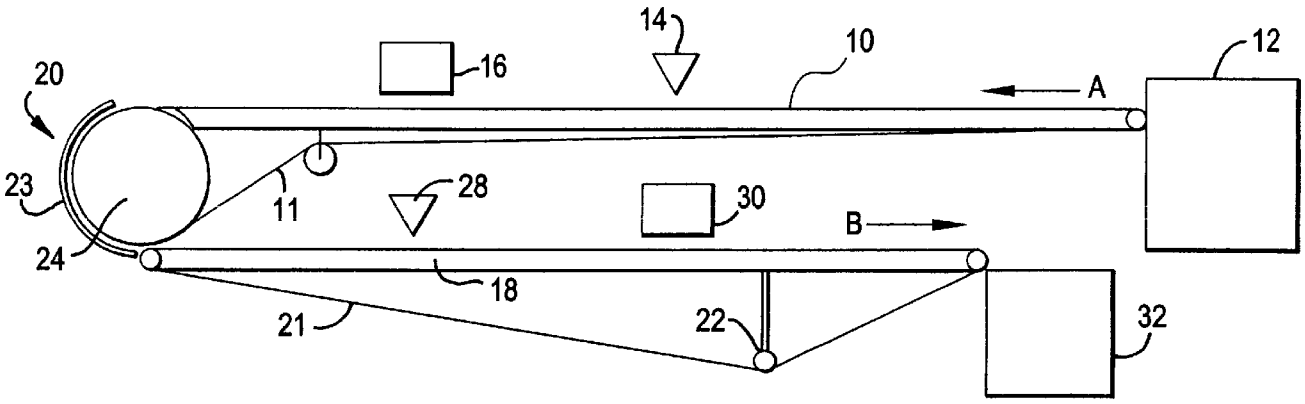
FIG. 1 is a schematic view of a first embodiment of the apparatus of the present invention having two conveyor units.

FIG. 1 schematically depicts the apparatus of the present invention. The apparatus includes a first conveyor unit 10 having a conveyor belt 11 in communication with a continuous feeder 12 containing a feeder pile of sheet-like substrates. The continuous feeder 12 allows for the stacking of the substrates into a large uniform load. The feeder 12 separates a sheet, or other substantially flat printing substrate, from the feeder pile and feeds the sheet onto the first conveyor unit 10. The feeder 12 is preferably a standard feeder known in the art of printing, such as those manufactured by Man Roland Inc., Komori Inc., or Heidelberg Inc. The first conveyor unit 10 is preferably a conveyorized vacuum table that subjects the sheet to a vacuum while it is being fed and/or supported by the first conveyor unit 10. In this preferred embodiment, the vacuum tables are in fluid communication with a source of negative pressure. These vacuum tables are well known in the art. However, any other type of conveyor may be utilized, such as a conveyor having a standard conveyor belt or a conveyor utilizing a gripping mechanism. Kepes Inc. manufactures a conveyorized vacuum table for feeding sheet material, which is suitable for the present invention.

A first printer unit 14 is disposed adjacent to the first conveyor unit 10. The first printer unit 14 prints a first side of the sheet being conveyed along the first conveyor unit 10. The first printer unit 14 can be an ink jet printing unit, a thermal printing unit, a laser printing unit, a video jet printing unit, or the like. Preferably, the first printer unit 14 is an ink jet printer unit. An example of an ink jet printer suitable for the present invention is made by Scitex, Inc. The material printed on the first side of the sheet is cured by a first curing unit 16 that is disposed adjacent to the first conveyor unit 10 at a position beyond the first printer unit 14 with respect to the direction of movement of the conveyor belt 11 (indicated by arrow A in FIG. 1). For purposes of this specification, the process of curing includes drying or any other process for increasing the bonding, adhesion, protection, or overall quality of a printed material on a substrate. Preferably, the material printed on the sheet is an ink and the curing unit 16 is an infrared light dryer. Infrared drying systems are well known in the art, such as those manufactured by Electrosprayer Systems Inc. or Oxy-Dry Inc. Essentially, infrared dryers evaporate solvents and/or water with infrared light and heat generated by the infrared light.

After the material printed on the first side of the sheet is cured, the sheet is transferred to a second conveyor unit 18 via a transfer device 20. The second conveyor unit includes a conveyor belt 21 and a tension adjuster 22. The transfer device 20 includes a curved deflector 23 that guides the sheet as it moves on the conveyor belt 11 around a cylindrically-shaped transfer roller 24. The deflector 23 is concentrically positioned around approximately half of the transfer roller 24, as shown in FIG. 1. In an alternate embodiment, the transfer roller 24 may include grippers (not shown) or vacuum openings (not shown) in fluid communication with a source of negative pressure in lieu of the deflector 23 to hold the sheet thereto during transfer.

The transfer device 20 transfers the sheet onto the second conveyor unit 18 such that the first printed surface of the sheet faces downwardly on the second conveyor unit 18. Similar to the first conveyor unit 10, the second conveyor unit 18 is also preferably a conveyorized vacuum table. However, any type of conveyor may be used, including a conveyor having a standard conveyor belt or a conveyor utilizing a gripping mechanism. In the preferred embodiment, the vacuum action of the second conveyor unit 18 aids in transferring the sheet by pulling the sheet and guiding it onto the conveyor belt 21 as it exits the transfer device 20.

A second printer unit 28 is disposed adjacent to the second conveyor unit 18. The second printer unit 28 prints a second side of the sheet being conveyed along the second conveyor unit 18. Similar to the first printer unit 14, the second printer unit 28 can be an ink jet printing unit, a thermal printing unit, a laser printing unit, a video jet unit or the like. Preferably, the second printer unit 28 is an ink jet printing unit. A second curing unit 30 is disposed adjacent to the second conveyor unit 18 at a position beyond the second printer unit 28 with respect to the direction of movement of the conveyor belt 21 (indicated by arrow B in FIG. 1). The second curing unit 30 cures the material printed on the second surface of the sheet. Preferably, the material printed on the sheet is an ink and the second curing unit 30 is an infrared light dryer.

After the second surface of the sheet is printed and cured, the second conveyor unit 26 conveys the sheet to a delivery system 32. The delivery system 32 collects the printed sheets to form a delivery pile of sheets contained within the delivery system 32. The delivery system is preferably a standard delivery known in the art of printing apparatus, such as those manufactured by Man Roland Inc., Komori Inc., or Heidelberg Inc. The delivery pile of sheets can be removed from the delivery system 32 as finished product or they can also be further processed by other processing equipment (not shown) that can be connected to the delivery system 32. An additional conveyor unit may be used to carry the printed sheets from the delivery system 32 or directly from the second conveyor unit 18 for further processing. Alternatively, the second conveyor unit 18 can include other processing steps in addition to printing and drying/curing.

Figure 2:
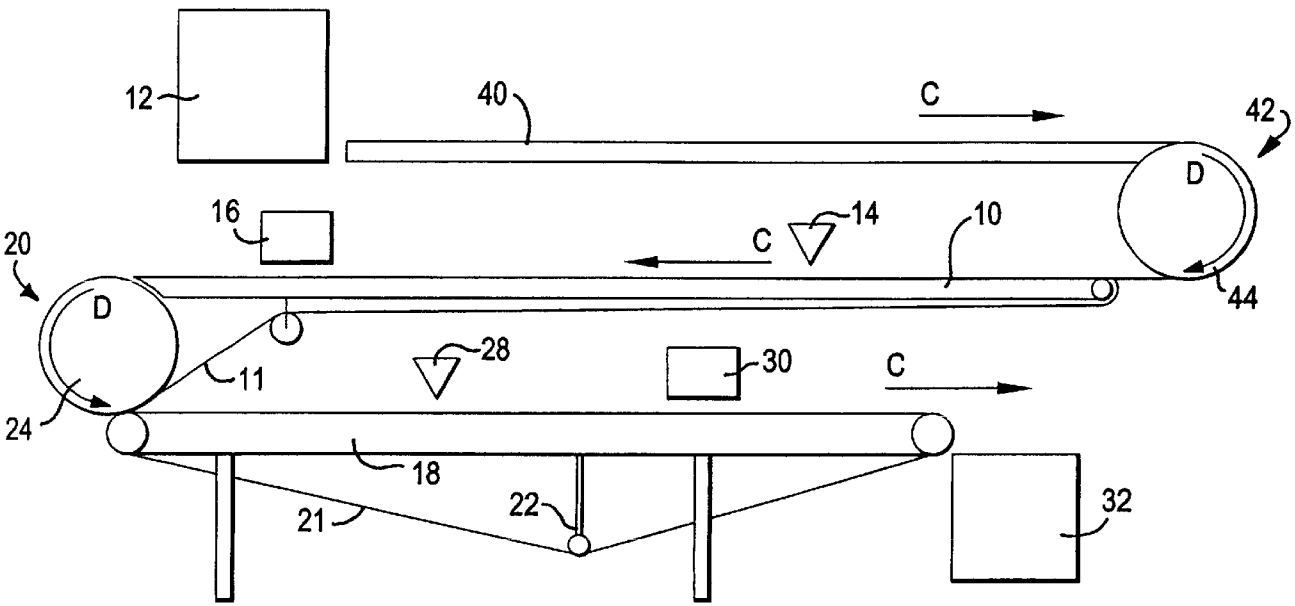
FIG. 2 is a schematic view of a second embodiment of the present invention having three conveyor units.

FIG. 2 schematically depicts an alternate embodiment of the apparatus of the present invention. For purposes of clarity, elements of the apparatus shown in FIG. 2 that are the same as those shown in FIG. 1 share the same element numbers. In the embodiment shown in FIG. 2, the apparatus includes a third conveyor unit 40 that is positioned in communication with the conveyor unit 10 via a second sheet transfer unit 42 having a transfer roller 44. The third conveyor unit 40 allows the continuous feeder 12 to be positioned on an opposite side of the apparatus with respect to the delivery 32. The apparatus of FIG. 2 avoids space constraints incurred by positioning both the continuous feeder 12 and the delivery 32 on one side of the apparatus. The third conveyor unit 40 can also be utilized for other processing steps. Arrows C indicate the direction of movement of the conveyor units 10, 18 and 40. Arrows D indicate direction of rotation of the transfer rollers 24 and 44. FIG. 2 depicts the transfer rollers 24 and 44 without a sheet deflector, such as sheet deflector 23. In this embodiment, the transfer rollers 24 and 44 incorporate a vacuum mechanism (not shown) to aid in transferring the sheet.

The apparatus and method of the present invention provides for duplex printing of sheet-like substrates in a continuous single-pass printing process that is well suited for industrial and commercial printing applications. The apparatus is capable of providing multiple color or single color printing of a variety of sheet-like substrates having various thicknesses. The in-line processing of the printed sheets minimizes damage to the printed portions of the sheets. The apparatus and method of the present invention also minimizes the number of contact points with the sheet as it is printed and processed, thereby further reducing damage and increasing the quality of the finished product. Furthermore, the single-pass duplex printing process significantly reduces printing cycle times for two-sided printing by eliminating the need for processing the sheets twice for printing.

It is to be understood that the apparatus of the present invention may be used alone or as part of a larger apparatus for performing a printing step of a process. While the specific embodiments have been illustrated and described, numerous modifications come to mind without significantly departing from the spirit of the invention and the scope of protection is only limited by the scope of the accompanying Claims.

What is claimed is:

1. An apparatus for printing on two sides of a sheet-like substrate comprising:

a feeder;

a first conveyor unit for receiving the sheet-like substrate from the feeder;

a first printing unit disposed adjacent to the first conveyor unit for applying media to a first surface of the sheet-like substrate;

a first curing unit for curing the media applied to the first surface of the sheet-like substrate;

a second conveyor unit in communication with and disposed underneath the first conveyor unit;

a transfer unit for transferring the sheet-like substrate from the first conveyor unit to the second conveyor unit, the transfer unit including a sheet deflector disposed adjacent to a transfer roller in communication with the first conveyor unit to controllably deflect the substrate to allow it to turn under the first conveyor unit, thereby effectuating transfer of the substrate to the second conveyor unit;

a second printing unit disposed adjacent to the second conveyor unit for applying media to a second surface of the sheet-like substrate; and a second curing unit for curing the media applied to the second surface of the sheet-like substrate.

2. The apparatus of claim 1, further including a delivery system for receiving the sheet-like substrate from the second conveyor unit.

3. The apparatus of claim 1, wherein the first and second conveyor units are conveyorized vacuum tables.

4. The apparatus of claim 1, wherein the first and second printing units are selected from the group consisting of an ink jet printing unit, a laser printing unit, a video jet printing unit, and a thermal printing unit.

5. The apparatus of claim 1, wherein the first and second ink curing units are infrared light dryers.

6. The apparatus of claim 1, wherein a third conveyor unit and a second transfer unit are disposed between the feeder and the first conveyor unit, wherein the third conveyor unit receives the sheet-like substrate from the feeder and the second transfer unit transfers the sheet-like substrate to the first conveyor unit.

7. An apparatus for duplex printing a substrate comprising:

a first conveyorized vacuum table capable of conveying the substrate;

a first means for printing the substrate conveyed by the first conveyorized vacuum table;

a second conveyorized vacuum table capable of conveying the substrate and in communication with the first vacuum table, the second conveyorized vacuum table disposed underneath first vacuum table;

means for turning and transferring the substrate from the first vacuum table to the second vacuum table; and a second means for printing the substrate conveyed by the second vacuum table.

8. The apparatus of claim 7, wherein a feeder feeds the substrate onto the first conveyorized vacuum table.

9. The apparatus of claim 7, wherein a delivery system collects the substrate from the second conveyorized vacuum table.

10. The apparatus of claim 7, wherein a third conveyorized vacuum table is in communication with the second conveyorized vacuum table.

11. An apparatus for printing on two sides of a sheet-like substrate comprising:

a feeder for holding a plurality of sheet-like substrates;

a first conveyor unit in communication with the feeder, wherein a substrate is fed onto the conveyor unit and conveyed in a first direction;

a first printing unit disposed adjacent to the first conveyor unit, wherein the printing unit applies a print medium to a first surface of the substrate;

a first curing unit disposed adjacent to the first conveyor unit at a position downstream of the first printing unit with respect to the first conveying direction;

a second conveyor unit in communication with the first conveyor unit and disposed-underneath the first conveyor unit;

a transfer unit in communication with both the first and second conveyor units and including a sheet deflector disposed adjacent to a transfer roller in communication with the first conveyor unit to controllably deflect the substrate to effectuate its transfer such that the first printed side of the substrate is facing downwardly on the second conveyor unit and the sheet is conveyed in a second direction;

a second printing unit disposed adjacent to the second conveyor unit, wherein the second printing unit applies a print medium a second surface of the substrate;

a second curing unit disposed adjacent to the second conveyor unit at a position downstream of the second printing unit with respect to the second conveying direction; and a delivery system in communication with the second conveyor unit, wherein the printed substrates are collected.

12. The apparatus of claim 11, wherein the transfer roller includes at least one vacuum opening in communication with a source of negative pressure to hold the sheet to the transfer roller.

13. A method of duplex printing a substrate in a continuous and automated single-pass process, comprising the steps of:

feeding a sheet-like substrate onto a first conveyor unit;

applying a medium to a first surface of the substrate;

curing the medium on the first surface of the substrate;

rotating and transferring the substrate to a second conveyor unit disposed underneath the first conveyor unit, such that the first surface of the substrate is facing the second conveyor unit;

applying a medium to a second surface of the substrate; and curing the medium on the second surface of the substrate.

14. The method of claim 13, further including the step of collecting the cured substrate in a delivery system.

15. The method of claim 13, wherein the curing steps are carried out by exposing the medium to infrared light.

16. The method of claim 13, wherein the curing steps are carried out by exposing the medium to heated air.

17. The method of claim 13, wherein the medium is applied to the substrate by a printing unit selected from the group consisting of an ink jet printing unit, a laser printing unit, a video jet printing unit, and a thermal printing unit.

* * * * *